United States Patent [19]

Ducros et al.

[11] Patent Number: 4,460,109

[45] Date of Patent: Jul. 17, 1984

[54] DEVICE FOR THE DISTRIBUTION OF TWO PASTY SUBSTANCES IN REGULABLE PROPORTIONS

[75] Inventors: Luc Ducros; Roger Navarro, both of Castres, France; Charles Kaeser, Pully, Switzerland

[73] Assignee: Pierre Fabre S.A., Paris, France

[21] Appl. No.: 485,799

[22] Filed: Apr. 18, 1983

[30] Foreign Application Priority Data

Apr. 19, 1982 [FR] France ..... 82 06660

[51] Int. Cl.[3] ..... B65D 35/22; B29F 3/00

[52] U.S. Cl. ..... 222/94; 222/145; 425/130

[58] Field of Search ..... 222/94; 425/130

[56] References Cited

U.S. PATENT DOCUMENTS 4,271,984 6/1981 Ducros et al. ..... 222/94

*Primary Examiner*—Willard E. Hoag

*Attorney, Agent, or Firm*—Pollock, Vande Sande & Priddy

[57] ABSTRACT

This invention relates to a device for the distribution in regulable proportions of two pasty substances which are contained separately inside a deformable tube.

The device comprises a distributor which is mounted so that it pivots inside a cylindrical casing which is integral with a cap fitted on the outlet orifice of the deformable tube. The casing comprises two outlets for the two pasty substances contained in the tube, and a common extrusion orifice.

The invention is notably used for the distribution of sun care products comprising a pasty excipient and an active pasty substance.

10 Claims, 7 Drawing Figures

10
12
14
16
18
20
22
24
26
28
30
32
34
36
38
40
42
44
46
48
50
52
X
Y
II

DEVICE FOR THE DISTRIBUTION OF TWO PASTY SUBSTANCES IN REGULABLE PROPORTIONS

This invention relates to a device for the distribution of pasty substances.

The U.S. Pat. No. 4,271,984 describes a device for the distribution in a regulable proportion of two pasty substances which are contained separately inside a deformable tube provided with an outlet orifice, comprising a cap which may be fitted on the outlet orifice of the tube to define two chambers inside the tube which are capable of containing the two pasty substances, and two corresponding outlets opening on to an outlet surface of the cap, a distributor mounted pivotally on the cap about an axis perpendicular to the axis of the outlet orifice of the tube and pivotable between two extreme positions, between which a cylindrical surface of the distributor sweeps over the outlet surface of the cap, the distributor having one or two passages opening through an inlet section in the cylindrical surface of the distributor and terminating in a common extrusion outlet, the inlet section or sections freeing the two outlets of the outlet surface of the cap to a greater or lesser extent depending on the pivoting position of the distributor.

In the various embodiments according to the above-mentioned patent, the common extrusion outlet is formed by a small common tube which is integral with the distributor, and the angle of rotation of the latter is restricted.

An object of the present invention is to improve the operation of the device of the above-mentioned French Patent by significantly increasing the angle of rotation of the distributor and by making it possible to obtain a more marked difference between the different positions of the distributor.

Another object of this invention is to improve the tightness of the distributor and to improve the manufacture thereof.

According to an essential characteristic of this invention, the distributor is mounted so that it pivots inside a cylindrical casing which is integral with the cap.

In a first embodiment of the present invention, the passages of the distributor comprise two channels formed in the cylindrical surface of the distributor and are capable of communicating on one side with the two outlets of the cap and on the other side with the extrusion orifice of the casing.

In a second embodiment of the present invention, the passage of the distributor comprises a hollow which is made through the distributor and is restricted on one side by a rectilinear flank perpendicular to the axis of rotation of the distributor and is restricted on the other side by a helical flank, the hollow communicating on one side with the two outlets of the cap and on the other side with the extrusion orifice of the casing.

In this embodiment, the hollow is interrupted by a solid part of the cylindrical surface of the distributor which is provided to seal the extrusion orifice of the casing when the distributor is in its closed position.

In a third embodiment of the present invention which is similar to the second embodiment mentioned above, the hollow is interrupted by two opposing solid parts of the cylindrical surface of the distributor which are intended respectively to seal the two outlets of the cap and the extrusion orifice of the casing when the distributor is in its closed position.

Other characteristics and advantages of the present invention will be revealed from the detailed description which follows and which refers to the accompanying drawings which are merely provided as an illustration of the invention.

Figures 1, 2:
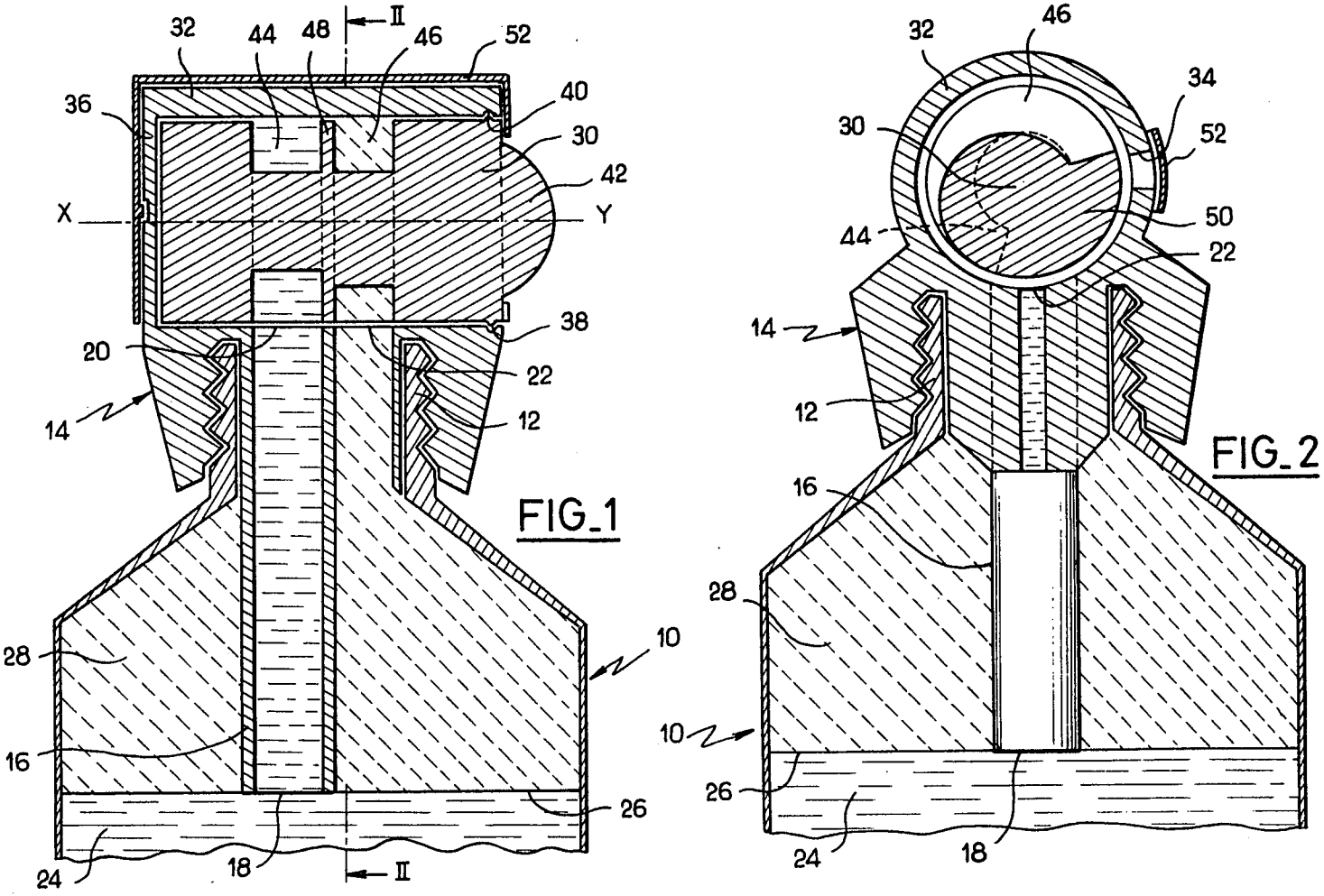
FIG. 1 is a sectional view, along a plane passing through the axis of rotation of the distributor, of a device according to the first embodiment mentioned above.
FIG. 2 is a sectional view along line II—II of FIG. 1.
Figure 6:
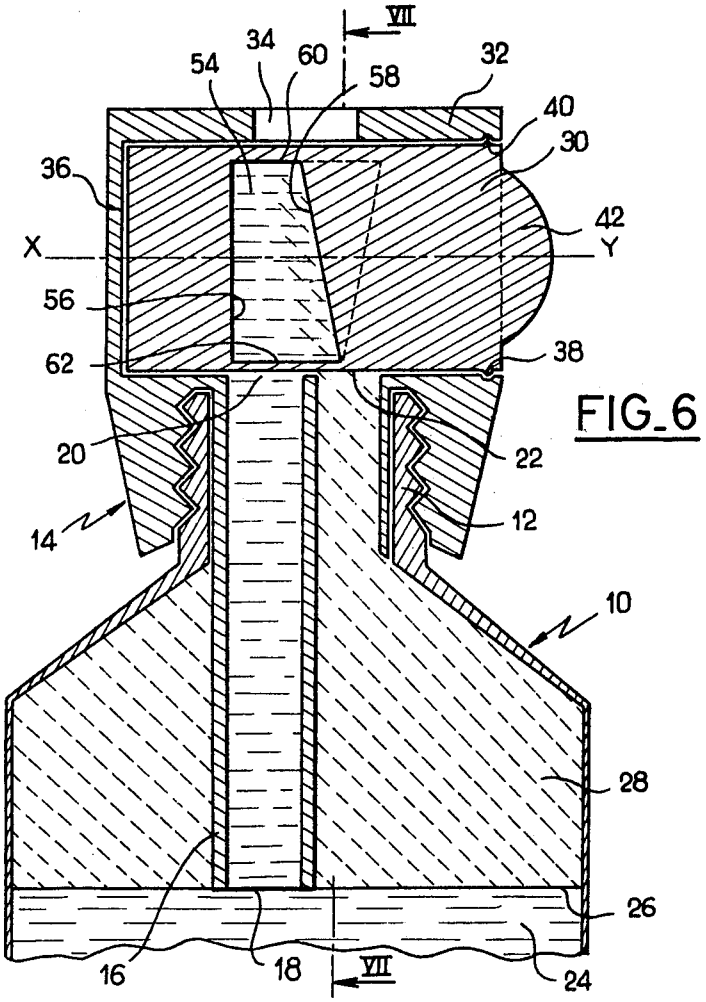

FIG. 6 is a sectional view, along a plane passing through the axis of rotation of the distributor, of a device according to the third embodiment mentioned above; and FIG. 7 is a sectional view along line VII—VII of FIG. 6, The device which is illustrated in FIGS. 1 and 2 comprises a deformable tube 10 which is made of, for example, a metallic material or a plastics material and is provided with an externally threaded outlet orifice 12. A cap 14 is screwed onto the threaded orifice 12 of the tube 10 and it comprises a small tube 16 which plunges inside the tube 10, the lower end 18 of the tube 16 just reaching a determined depth with respect to the bottom of the tube (not shown) and the upper end of the tube 16 opening on to a part 20 of an outlet surface of the cap 14 which has a cylindrical profile of axis XY (see FIG. 1), this axis XY lying in the plane of FIG. 1 and being perpendicular to the plane of FIG. 2.

The tube 10 contains a first pasty substance 24 which fills the tube 10 from the bottom up to the level 26 of the lower end 18 of the small tube 16. A second pasty substance 28 fills the peripheral chamber delimited inside the tube 10 around the small tube 16 and above the level 26.

When a pressure is exerted on the deformable tube 10, the first pasty substance 24 tends to be extruded from the tube through the small tube 16, while the second pasty substance 28 tends to be simultaneously extruded from the tube through an outlet 22.

The relative proportions of the pasty substances 24 and 28 in the mixture are controlled by means of a distributor 30 mounted inside a casing 32 integral with the cap 14 so that it pivots about the above-mentioned axis XY, the internal cylindrical wall of the casing comprising the outlet surfqce of the cap.

The casing 32 comprises a cylindrical surface which comprises on the one hand the above-mentioned outlets 20 and 22 and on the other hand an extrusion orifice 34 to allow the extrusion of the mixture of the two pasty substances, the proportion of which is regulated by the distributor 30. The extrusion orifice 34 is positioned substantially at 90° with respect to the two outlets 20 and 22.

The casing 32 has at one end a bottom wall 36, whereas its opposite end is open to allow the introduction of the distributor 30. The distributor 30 is generally cylindrical with an annular flange 38 cooperating with an annular slot 40 in the casing 36, so that the distributor may rotate in the casing without becoming axially displaced.

The rotation of the distributor 30 is ensured manually by a manipulating notch 42 which is positioned along a diameter of the distributor and which is also used to indicate the position of the distributor. The distributor 30 comprises two passages allowing the distribution of the two pasty substances which have issued respectively from the two outlets 20 and 22, and allowing their extrusion through the common outlet 34. These passages comprise two parallel channels 44 and 46 which are made in the cylindrical surface of the distributor and are separated by a partition 48.

The channel 44 has a constant depth, whereas the channel 46 is produced in a spiral shape so that it has a variable depth. The two channels 44 and 46 are interrupted by a solid part 50 which extends over at least a quarter of the periphery of the distributor 30 (see FIG. 2). Thus, when the distributor is in its closed position, the solid part 50 simultaneously seals the extrusion orifice 34 and the outlets 20 and 22 of the cap.

The depth of the channel 46 of the level of the outlet 22 varies depending on the position of the distributor, which makes it possible to vary the relative proportions of the two pasty substances.

The device of FIGS. 1 and 2 also comprises a cover 52 in the form of a mobile visor which pivots outside the casing 32 and makes it possible to seal the extrusion orifice 34 and to complete the tightness of the device when the distributor is in its closed position. The cover 52 rotates integrally with the distributor 30, to which it is joined by means of the manipulating notch 42.

In the embodiment of FIGS. 1 and 2, the orifice 34 is positioned substantially at 90° with respect to the outlets 20 and 22, which makes it possible to rotate the distributor qver about three quarters of a rotation and thus to ensure a maximum clearance of the distributor.

It is possible to position the extrusion orifice 34 at an angle of from 90° to 180° with respect to the outlets 20 and 22, but this is to the detriment of the clearance of the distributor.

Figures 3, 4, 5:
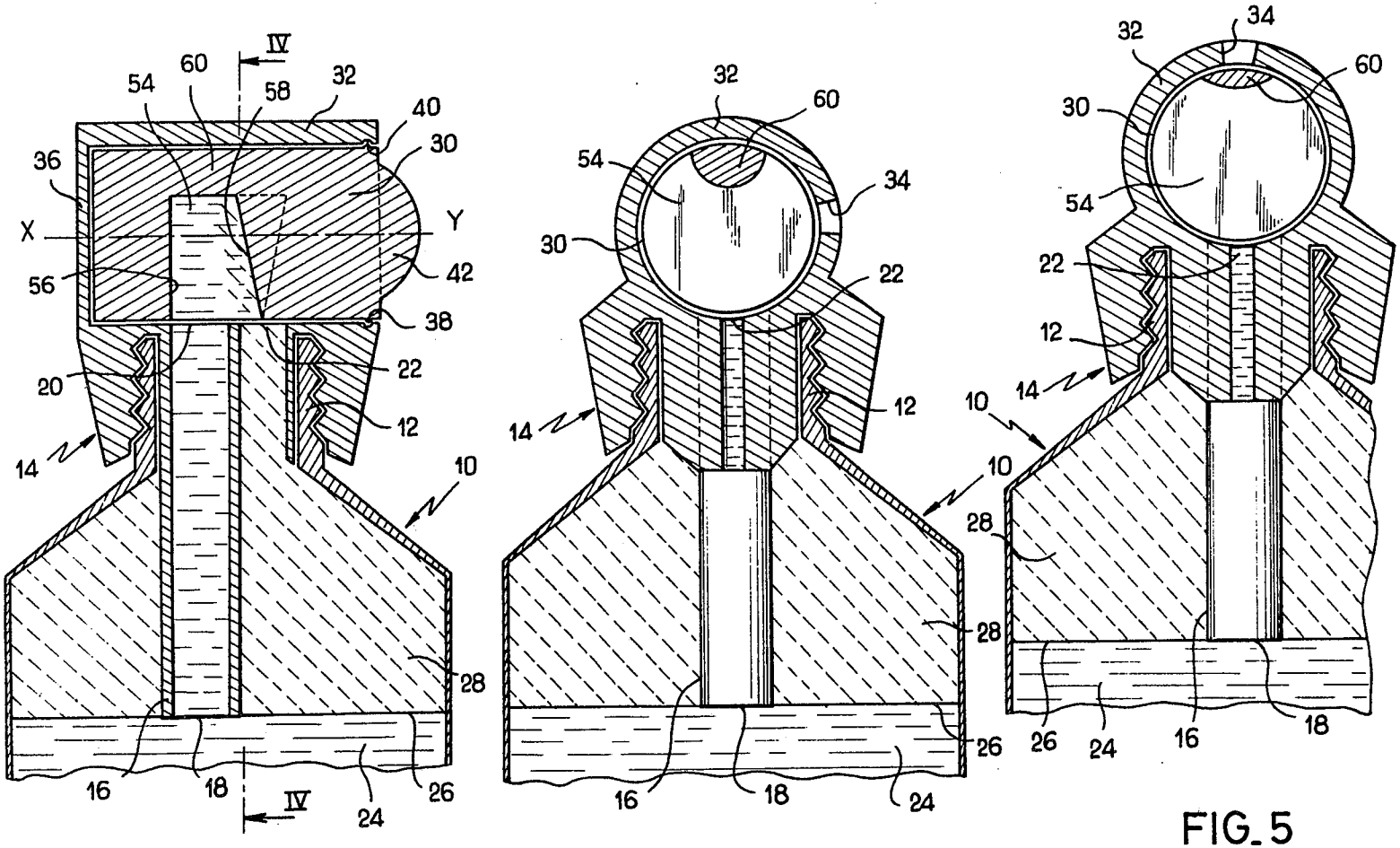
FIG. 3 is a sectional view, along a plane passing through the axis of rotation of the distributor, of a device according to the second embodiment mentioned above.
FIG. 4 is a sectional view along line IV—IV of FIG. 3.
FIG. 5 is a sectional view similar to that of FIG. 4 illustrating another variant according to the second embodiment.

The device which is illustrated in FIGS. 3 and 4 retains the main characteristics of the device of FIGS. 1 and 2, and only the passage means of the distributor 30 are different. In effect, the distributor comprises a single passage consisting of a cavity 54 which is made through the distributor 30. This cavity is restricted on one side by a rectilinear flank 56 which is perpendicular to the axis of rotation XY of the distributor and is restricted on the other side by a helical flank 58.

The cavity 54 communicates with the two outlets 20 and 22 and with the extrusion orifice 34. The flanks 56 and 58 are positioned such that the outlet 20 is uncovered at all times and the outlet 22 is uncovered to a greater or lesser extent when the distributor 30 is not in its closed position.

The cavity 54 is interrupted by a solid part 60 of the cylindrical surface of the distributor which seals the extrusion orifice 34 when the distributor is closed.

In the embodiment of FIGS. 3 and 4, the orifice 34 is substantially at a right angle with respect to the outlets 20 and 22, which measure makes it possible to seal a maximum clearance of the distributor.

The device according to the variant illustrated in FIG. 5 differs from that of FIGS. 3 and 4 only in the position of the extrusion orifice 34, which is at 180° with respect to the outlets 20 and 22. This restricts the clearance of the distributor 30, but allows a more convenient use since the substances are then extruded at the top of the tube 10.

Figure 7:
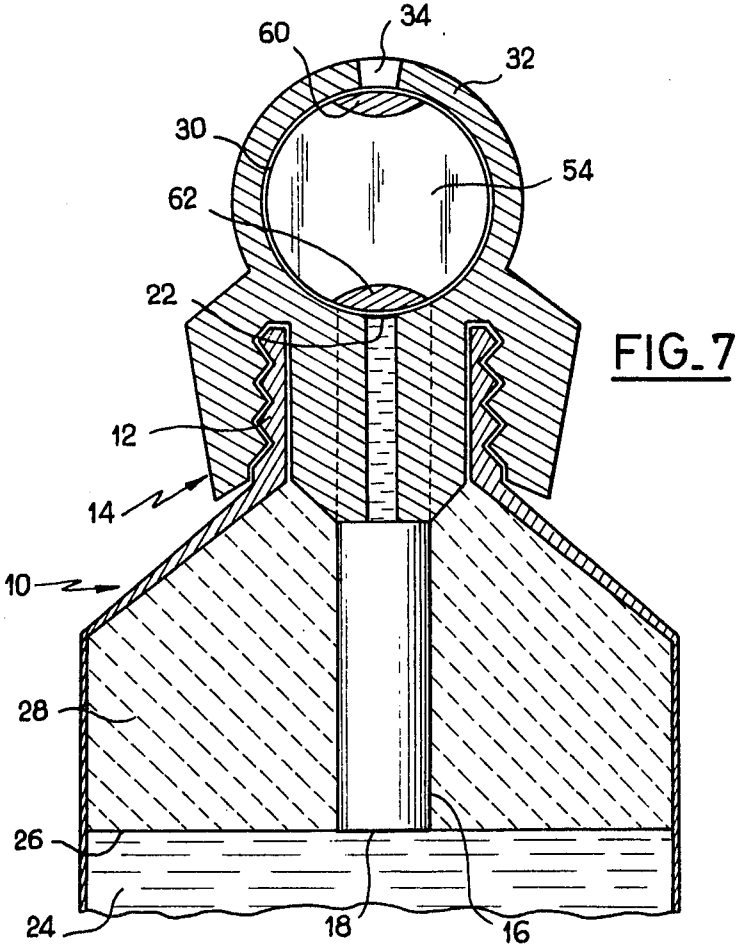

The device illustrated in FIGS. 6 and 7 is practically indentical to that of FIG. 5.

However, in this embodiment, the cavity 54 is interrupted by two diametrically opposite, solid parts 60 and 62 of the cylindrical surface of the distributor 30. This makes it possible to complete the tightness by simultaneously obstructing the outlets 20 and 22 and the extrusion orifice 34 when the distributor is in its closed position.

It is to be understood that the devices of FIGS. 3 to 7 may also be provided with the cover 52 of the device of FIGS. 1 and 2.

It will be noted that the clearance of the distributor of the devices illustrated in FIGS. 1 to 7 is always clearly greater than that of the distributor of the main patent.

The device of the present invention allows the distribution, in a regulable proportion, of two pasty substances which are contained inside a deformable tube. A preferred use is the distribution of a sun care product containing a pasty excipient, such as a cream, and an active pasty substance which acts as a sun filter, the proportion of which should be modified with respect to the excipient depending on the conditions of use of the product.

We claim:

1. A device for the distribution, in regulable proportions, of two pasty substances, comprising a deformable tube for separately containing said pasty substances and provided with an outlet orifice, a cap adapted to be fitted on the outlet orifice of said tube to define two chambers inside said tube which are capable of containing said two pasty substances, a distributor mounted so that it can pivot in said cap between two extreme positions about an axis perpendicular to the axis of said outlet orifice of said tube, said distributor being mounted such that a cylindrical surface thereof sweeps over a substantially cylindrical inner surface of said cap between said positions, said distributor having at least one passage opening through an inlet section in the cylindrical outer surface thereof and being terminated by a common extrusion outlet, and said distributor being mounted so that it pivots inside a cylindrical casing which is integral with said cap and bears a common extrusion orifice and two corresponding tube outlets opening in a curved surface abutting said distributor.

2. A device according to claim 1, also comprising a cover which is mounted so that it pivots outside the cylindrical casing and is capable of sealing the extrusion orifice of the casing.

3. A device according to claim 1, wherein the passages of the distributor comprise two channels which are made in the cylindrical surface of the distributor and are capable of communicating on one side with the two tube outlets of the cap and on the other side with the extrusion orifice of the cylindrical casing.

4. A device according to claim 3, wherein the two channels are interrupted by a solid part over at least a quarter of the periphery of the distributor.

5. A device according to claim 3, wherein one of the channels has a constant depth, whereas the other channel is produced in spiral form so that it has a variable depth.

6. A device according to claim 5, wherein the two tube outlets of the cap and the extrusion orifice of the cylindrical casing are substantially at 90° .

7. A device according to claim 1, wherein the passage of the distributor comprises a cavity which is made through the distributor and is restricted on one side by a rectilinear flank perpendicular to the axis of rotation of the distributor and is restricted on the other side by a helical flank, the cavity communicating on one side with the two tube outlets of the cap and on the other side with the extrusion orifice of the cylindrical casing.

8. A device according to claim 7, wherein the cavity is interrupted by a solid part of the cylindrical surface of the distributor which is to seal the extrusion orifice of the cylindrical casing when the distributor is in its closed position.

9. A device according to claim 7, wherein the cavity is interrupted by two diametrically opposite, solid parts of the cylindrical surface of the distributor which are to seal respectively the extrusion orifice of the cylindrical casing and the two tube outlets of the cap when the distributor is in its closed position.

10. A device according to claim 9, wherein the two tube outlets of the cap and the extrusion orifice of the cylindrical casing are at 180°.

* * * * *